United States Patent [19]

Davies et al.

[11] Patent Number: 4,908,159

[45] Date of Patent: Mar. 13, 1990

[54] DETERGENT GRANULES CONTAINING SIMPLE SUGARS AND A SEED CRYSTAL FOR CALCIUM CARBONATE

[75] Inventors: James F. Davies; Robert S. Lee; Andrew W. Travill, all of Merseyside; Robert J. Williams, Oxford, all of England

[73] Assignee: Lever Brothers Company, New York, N.Y.

[21] Appl. No.: 224,229

[22] Filed: Jul. 22, 1988

Related U.S. Application Data

[63] Continuation of Ser. No. 862,073, May 12, 1986, abandoned.

[30] Foreign Application Priority Data

May 10, 1985 [GB] United Kingdom ..... 8511858

[51] Int. Cl.[4] ..... C11D 9/12

[52] U.S. Cl. ..... 252/559; 252/174.14; 252/174.21; 252/174.24

[58] Field of Search ..... 252/174.21, 174.14, 252/174.24, 559

[56] References Cited

U.S. PATENT DOCUMENTS

| | | | |
|---|---|---|---|
| 1,968,628 | 7/1934 | Alton | 87/16 |
| 3,615,811 | 10/1971 | Barrett | 106/306 |
| 3,915,878 | 10/1975 | Yurko | 252/89 |
| 4,013,578 | 3/1977 | Child | 252/140 |
| 4,051,054 | 9/1977 | Davies et al. | 252/109 |
| 4,076,653 | 2/1978 | Davies et al. | 252/532 |
| 4,311,609 | 1/1982 | Wagner, III et al. | 252/174.25 |
| 4,530,774 | 7/1985 | Davies et al. | 252/108 |

FOREIGN PATENT DOCUMENTS

| | | |
|---|---|---|
| 991942 | 6/1976 | Canada . |
| 0126551 | 11/1984 | European Pat. Off. . |
| 0164778 | 12/1985 | European Pat. Off. . |
| 1239407 | 7/1971 | United Kingdom . |
| 1358407 | 2/1975 | United Kingdom . |
| 1481685 | 8/1977 | United Kingdom . |
| 1515273 | 6/1978 | United Kingdom . |
| 1568420 | 5/1980 | United Kingdom . |
| 2161826 | 1/1986 | United Kingdom . |

*Primary Examiner*—John F. Niebling
*Assistant Examiner*—Isabelle Rodríguez
*Attorney, Agent, or Firm*—Gerard J. McGowan, Jr.

[57] ABSTRACT

Silicate free detergent granules contain a seed crystal for calcium carbonate, such as calcite, a non-soap detergent active, especially an anionic active and a sugar such as sucrose to provide good mechanical strength, good dispersibility and other benefits. An alkali metal (e.g. sodium) carbonate may be present in the granules. The granules may be used as such to wash fabrics or may be added to a composition containing sodium carbonate and other conventional ingredients. The granules may be made by spray-drying or pan granulation.

2 Claims, No Drawings

DETERGENT GRANULES CONTAINING SIMPLE SUGARS AND A SEED CRYSTAL FOR CALCIUM CARBONATE

This is a continuation, application of Ser. No. 862,073, filed May 12, 1986, abandoned.

TECHNICAL FIELD

This invention relates to detergent granules, in particular to detergent granules containing a water-insoluble material such as calcium carbonate. The invention also relates to detergent compositions consisting of or containing the granules and to methods of making the granules.

BACKGROUND ART

Detergent compositions usually contain, in addition to a detergent active material, a detergency builder whose role, inter alia, is to remove hardness ions from the wash liquor which would otherwise reduce the efficiency of the detergent active material. Water-soluble phosphate materials have been extensively used as detergency builders. However for a number of reasons, including eutrophication allegedly caused by phosphates and cost, there has been a desire to use alkali metal carbonates especially sodium carbonate instead. Alkali metal carbonate detergency builders suffer however from a number of disadvantages. Firstly, the reaction between the alkali metal carbonate and calcium ions which are present in hard water results in the formation of water-insoluble calcium carbonate which, depending on the conditions, may be in such a form as to become deposited on the washed fabrics. Secondly, the reaction between the alkali metal carbonate and the calcium ions of the water is slow, especially at low temperatures and is readily inhibited by materials which act as calcium carbonate precipitate growth inhibitors, referred to herein as poisons. The result of this is that the concentration of calcium ions in the wash liquor is not reduced as far or as fast as desired, so that some free calcium ions are still available to reduce the efficiency of the detergent active material.

As a possible solution to this problem it has been proposed to include in the detergent composition, a water-insoluble material which would act as a seed crystal for the precipitated calcium carbonate and would adsorb the poisons from the wash liquor. Among other materials, finely divided calcite has been proposed as such a material - see British Patent Specification GB 1 437 950 (UNILEVER).

However, the inclusion of calcite in detergent compositions is hampered by its physical form. One might consider putting small particle size calcite in a slurry together with other ingredients for spray-drying, but we have found that where alkali metal silicates are included this process leads to a loss of calcite seed activity as a result of poor dispersibility. Calcite having a large surface area is preferred for maximum seed activity, but generally such material has a relatively small particle size, is dusty and is therefore difficult to handle. One alternative is to handle the calcite in a slurry, without drying to a powder, but this could also involve high storage and transport costs. It is therefore necessary to granulate the calcite, for example by conventional techniques of pan granulation or spray-drying, and to keep any silicate away from the calcite. The term "granulation" is used herein to mean any process of agglomerating fine particles into granules of a suitable size for incorporation into, or use directly as, detergent compositions.

Granulation of the calcite with a suitable binding agent has been proposed, for example in British Patent Specification GB 1 515 273 (UNILEVER). However, in order to be effective in its intended role in the wash liquor, it is necessary for the calcite to disperse rapidly when the product is added to water. Binding agents have generally been found to seriously reduce the dispersibility of the calcite.

Attempts to granulate calcite with materials known to be good dispersing agents, for example some non-ionic detergent active materials, have also not been successful. The resulting granules may not have the necessary mechanical strength to solve the handling problems of the calcite. Attempts to discover a material which will act both as an adequate binding agent and a dispersant have not so far been successful.

The problem is further complicated by the fact that some binding agents and dispersing agents proposed in the prior art are themselves poisons and will therefore reduce the seed activity of the calcite, thereby further adding to the problems which the calcite is intended to solve.

DISCLOSURE OF THE INVENTION

We have now surprisingly discovered that granulation with a specific mixture of materials can lead to granules having acceptable mechanical strength and dispersibility without loss of seed activity.

Therefore, according to a first aspect of the invention, there is provided a silicate-free detergent granule comprising at least:

(i) a water-insoluble particulate carbonate material which is a seed crystal for calcium carbonate;

(ii) a non-soap detergent active material which is a dispersant for the water-insoluble particulate carbonate material; and (iii) sugar as herein defined.

THE SUGAR

By the term "sugar" is meant a mono-, di- or poly saccharide or a derivative thereof, or a degraded starch or chemically modified degraded starch which is water soluble. The saccharide repeating unit can have as few as five carbon atoms or as many as fifty carbon atoms consistent with water solubility. The saccharide derivative can be an alcohol or acid of the saccharide as described in Lehninger's Biochemistry (Worth 1970). By "water-soluble" in the present context it is meant that the sugar is capable of forming a clear solution or a stable colloidal dispersion in distilled water at room temperature at a concentration of 0.01 g/l.

Amongst the sugars which are useful in this invention are sucrose, which is most preferred for reasons of availability and cheapness, glucose, fructose, maltose (malt sugar) and cellobiose and lactose which are disaccharides. A useful saccharide derivative is sorbitol.

We are aware of U.S. Pat. No. 3,615,811 (BARRETT assigned to CHEMICAL PRODUCTS CORPORATION) which discloses the use of sugars as binding agents for alkaline earth metal carbonates, particularly barium carbonate, for use in the ceramic industry. For this purpose less than 5% binder is recommended for use. We are also aware of British Patent Specification GB-A-1 568 420 (COLGATE-PALMOLIVE COMPANY) which discloses the use of water-soluble organic materials, including sugars, as binding agents for aluminosilicate detergency builder materials, such as finely divided zeolites, to improve the handling properties thereof.

Some inorganic salts can have a deleterious effect on the properties of the granule. Alkali metal silicates for example should be avoided. It is believed that silicates act to cement together the particles of the water-insoluble carbonate material in such a manner as to severely reduce their seed activity, this activity not being regained when the granule is added to water. If any water-soluble silicate material is present in the additive the weight ratio thereof to the water-insoluble carbonate material should be less than 1:10, preferably less than 1:100.

THE WATER-INSOLUBLE PARTICULATE CARBONATE MATERIAL

The granule necessarily contains a water-insoluble particulate carbonate material. This material must be capable of acting as a seed crystal for the precipitate which results from the reaction between the calcium hardness ions of the water and the water-soluble carbonate. Thus this water-insoluble particulate material is a seed crystal for calcium carbonate, such as calcium carbonate itself.

The water-insoluble particulate carbonate material should be finely divided, and should have a surface area of at least 10 $m^2/g$, and preferably at least 15 $m^2/g$. The particularly preferred material has surface area from 30–100 $m^2/g$. Insoluble carbonate material with surface areas in excess of 100 $m^2/g$ may be used, if such materials are economically available.

Surface area is measured by nitrogen adsorption using the standard Bruauer, Emmet & Teller (BET) method. A suitable machine for carrying out this method is a Carlo Erba Sorpty 1750 instrument operated according to the manufacturer's instructions.

It is most preferred that the high surface area material be prepared in the absence of poisons, so as to retain its seed activity.

The insoluble carbonate material will usually have an average particle size of less than 10 microns, as measured by conventional techniques.

When the insoluble carbonate material is calcium carbonate, any crystalline form thereof may be used or a mixture thereof, but calcite is preferred as aragonite and vaterite are less readily available commercially, and calcite is a little less soluble than aragonite or vaterite at most usual wash temperatures. When any aragonite or vaterite is used it is generally in admixture with calcite. In the following general description, the term 'calcite' is used to mean either calcite itself or any other suitable water-insoluble calcium carbonate seed material.

THE NON-SOAP DETERGENT ACTIVE MATERIAL

The granules should contain a non-soap detergent active material as a dispersant for the calcite. Water-soluble nonionic or anionic detergent active materials or mixtures thereof are preferred, although semi-polar, zwitterionic, amphoteric or cationic detergent active materials may also be used, alone or in admixture with other detergent active materials. The use of an anionic detergent active material results in the added benefit of reducing the calcium carbonate deposition on fabrics. The detergent active material is preferably one which does not form a substantially insoluble calcium salt, as the presence of calcium ions in the wash liquor might then hinder the dispersibility of the granules. Soaps which do form a substantially insoluble calcium salt are therefore not preferred as the only detergent active material in the granules.

It is important that the dispersant does not act as a poison. The preferred dispersant is an anionic material such as an alkyl benzene sulphonate, especially where the alkyl group is linear. We have found that these materials do not act as poisons in the present context. This is surprising in view of the disclosures of Canadian Patent Specification CA-A-991 942 (BENJAMIN, granted to THE PROCTER & GAMBLE COMPANY) which teaches that certain anionic detergents interfere with the growth of free metal ions on a crystallisation seed.

THE COMPOSITION OF THE GRANULE

The level of calcite in the granules is preferably at least 15% by weight, most preferably at least 40% by weight. Below these levels it would be necessary to include too high a level of granules in the overall detergent composition, leaving insufficient space for other ingredients.

The level of detergent active in the granules is preferably more than 2% by weight, most preferably at least 5% by weight. Below these levels, dispersibility of the granules may be unsatisfactory.

The level of sugar in the granules is preferably more than 5% by weight. Below this level, the mechanical strength of the granules may be unsatisfactory.

The above percentage levels are based on the total weight of the calcite, detergent active and sugar in the granule. Other components may also be present in the granules, up to a total of preferably no more than 50% most preferably up to about 25% by weight of the granules. Thus water will usually be present to an extent determined by the processing method involved. Other components which may have a beneficial effect on the overall detergent composition may also be present, provided that they do not have a serious effect upon the seed activity, dispersibility and mechanical strength of the granules. Thus for example further dispersants and/or further binding agents may be present.

The presence of water-soluble flow aids such as sodium sulphate or carbonate can be beneficial during a granulation process Sodium carbonate also has the advantage of being a builder and it improves the granule properties when used in combination with the sugar.

The granule can constitute the whole of a detergent composition when it contains an alkali metal carbonate and sufficient detergent active material, especially where sodium silicate is not required to be in the composition. Alternatively, the granules according to the invention will be incorporated in a detergent composition which separately contains other ingredients.

DETERGENT ACTIVE MATERIALS IN THE COMPOSITION

An essential component of the composition is a detergent active material. This material may be selected from anionic, nonionic, amphoteric and zwitterionic detergent active compounds and mixtures thereof, which often do not form during use at normal product concentration in hard water excessively water insoluble calcium salts; this ensures that the detergent active compound is not precipitated as its calcium salt instead of calcium carbonate being precipitated. Some degree of precipitation of the detergent active compound or mixture of compounds in the form of the calcium salts may be tolerated, provided that after allowing for the subsequent redissolution of any of the calcium salt during the washing process, the amount of any more permanent precipitate is minor and an effective amount of detergent active compound is left in solution.

Many suitable synthetic detergent active compounds are commercially available and they are fully described in the literature, for example in "Surface Active Agents and Detergents" Volumes 1 and 2, by Schwartz, Perry and Berch.

The preferred detergent active compounds are fully described in GB 1 437 950 referred to above.

However, because the present invention enables the calcite to be rapidly dispersed, the use of soaps (and similar long chain carboxylates such as sucinates, malonates and sulphonated fatty acid salts) as detergent actives separate from the calcite granules is now made possible.

The effective amount of the detergent active compounds or compounds used in the compositions is generally in the range from 5 to 40% by weight, preferably not more than 30% by weight of the composition.

THE WATER-SOLUBLE CARBONATE MATERIAL

A further essential ingredient of the composition is a water-soluble carbonate material as a builder. This is preferably sodium or potassium carbonate or a mixture thereof, for reasons of cost and efficiency. The carbonate salt is preferably fully neutralised but it may be partially neutralised, for example a sesquicarbonate may be used in partial replacement of the normal carbonate salt; the partial salts tend to be less alkaline and therefore less efficient. The amount of water-soluble carbonate material in the detergent composition can be varied widely, but the amount should be at least 5% by weight, such as from 10% to 40%, preferably 10% to 30% by weight, though an amount of up to 75% could possibly be used if desired in special products The amount of the water-soluble carbonate material is determined on an anhydrous basis, though the salts may be hydrated either before or when incorporated into the detergent composition. It should be noted that it may also be desirable to limit the carbonate content to a lower level within the range mentioned, so as to decrease the risk of internal damage following any accidental ingestion, for example by children.

The selected level of calcite in the overall composition depends on the specific surface area as described above. The amount of calcite used in the compositions will usually be from 5% to 60% depending on the calcite surface area, typically from 5% to 30%. The granules should occupy at least 5% of the overall composition, preferably from about 10% to about 40% of the overall composition.

The size of the granules should be compatible with the remainder of the detergent composition, preferably in the average size range of 150 to 1800 microns, as measured by sieve analysis, most preferably from 180 to 1500 microns.

OTHER INGREDIENTS OF THE COMPOSITION

In addition to the granules, the detergent active material and the water-soluble carbonate material it is possible to include minor amounts of other detergency builders, provided that the total amount of the detergency builders does not exceed 85% by weight, so as to leave room in the detergent composition for other desirable ingredients.

Where a soap is used as a detergent active material it may be present in such a quantity that it will also contribute as an additional builder.

Apart from the calcite granules, the detergent active compounds and detergency builders, the detergent composition can optionally contain any of the conventional ingredients in the amounts in which such ingredients are normally employed in fabric washing detergent compositions. Where the calcite granules constitute the whole of the composition, these ingredients can be included in the granules.

One such optional ingredient is an alkali metal silicate, particularly sodium neutral, alkaline, meta- or orthosilicate. A low level of silicate, for example 5–10% by weight, is usually advantageous in decreasing the corrosion of metal parts in fabric washing machines, and it may give processing benefits. If higher levels of silicate are used up to a practical maximum of 30%, for example from 10% to 20% by weight, there can be a more noticeable improvement in detergency, which may permit some decrease in the water- soluble carbonate material content. This effect appears to be particularly beneficial when the wash liquor are used in water with appreciable levels of magnesium hardness. The amount of silicate can also be used to some extent to control the equilibrium pH of the wash liquor, which is generally within the range of 9–11, preferably 10–11 for an aqueous solution of the composition at the recommended concentration. It should be noted that a higher pH (i.e. over pH 10.5) tends to be more efficient as regards detergency, but it may be less desirable for domestic safety. Sodium silicate is commonly supplied in concentrated aqueous solution, but can be obtained as a free flowing powder. The amounts of silicate are calculated on an anhydrous basis.

Examples of other optional ingredients include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracids, peracid bleach precursors, chlorine-releasing bleaching agents such as trichloroisocyanuric acid, fabric softening agents, anticorrosion agents, inorganic salts such as sodium sulphate, and, usually present in very minor amounts, fluorescent agents, perfumes, enzymes such as proteases and amylases, germicides and colourants. A particularly effective bleaching agent is sodium perborate monohydrate having a surface area in excess of 5 $m^2/g$ and a positive caking index as described in European Patent Specification EP-A-164 778 (UNILEVER). Particularly when the composition does not contain an anionic detergent active material, it can be beneficial to include an anti-ashing material such as described in European Patent Specification EP-A 126551 (UNILEVER) to reduce the deposition of calcium carbonate onto fabrics.

PRODUCTION OF THE COMPOSITIONS

The detergent compositions may be produced by any of the techniques commonly employed in the manufacture of fabric washing detergent compositions, including particularly slurry-making and spray-drying processes for the manufacture of detergent powders.

The calcite granules may be prepared by the conventional techniques of agglomerating by means of a mechanical granulator such as an Eirich pan, or by spray drying.

In addition to the calcite granule, other granules can be prepared containing for example further detergent active, and silicate, for example by spray-drying, and these two granules are then mixed together, optionally along with other ingredients, in particular any sensitive ingredients such as bleaches and perfumes. If the calcite granule already contains sufficient detergent active material for the composition as a whole, these other granules may comprise sodium silicate or sodium silicate granulated with an inorganic salt such as sodium carbonate.

It will be seen from above and from the examples which follow that the calcite granules according to the invention provide benefits of acceptable mechanical strength, dispersibility and retained seed activity and where anionic detergent actives are involved, additionally the benefit of reduced deposition on fabrics.

The invention will now be illustrated by the following non-limiting examples.

EXAMPLE 1

A detergent granule was prepared having the following formulation, by preparing a slurry of the stated ingredients and spray-drying to the stated moisture content.

| Ingredient | Parts by Weight |
|---|---|
| Anionic detergent active[1] | 4.0 |
| Sodium carbonate[2] | 10.0 |
| Calcite[3] | 20.0 |
| Sucrose | 4.0 |
| Moisture[4] | 1.2 |
| Total | 39.2 |

Notes:
[1]Dobane 113 (ex Shell Chemicals) which is sulphonated to form approximately a sodium alkyl benzene sulphonate in which the alkyl group contains from 10 to 15 carbon atoms.
[2]Measured as anhydrous.
[3]Socal U3 (ex Solvay) having a nominal surface area of 100 $m^2/g$.
[4]Total water content including water of crystallisation.

Using a conventional spraying technique, 2.0 parts by weight of a nonionic detergent active material Synperonic A7 (ex ICI - an alcohol having an alkyl chain length of 13–15 carbon atoms ethoxylated with an average of 7 ethylene oxide groups per molecule) was sprayed on to the spray-dried calcite granules.

A spray-dried base powder was prepared having the following formulation, by preparing a slurry of the stated ingredients and spray-drying to the stated moisture content.

| Ingredient | Parts by Weight |
|---|---|
| Dobane 113 | 7.0 |
| Synperonic A7 | 2.0 |
| Sodium carbonate | 20.0 |
| Sodium silicate[5] | 8.0 |
| Minor conventional ingredients | 1.2 |
| Moisture | 5.5 |
| Total | 43.7 |

Note:
[5]Measured as anhydrous.

The calcite granules, the spray-dried base powder and further ingredients as specified below were then drymixed together to form the final product.

| Ingredient | Parts by Weight |
|---|---|
| Calcite granules | 41.2 |
| Base Powder | 43.7 |
| Conventional foam control agent | 1.5 |
| Sodium perborate monohydrate | 13.0 |
| Perfume | 0.2 |
| Enzyme | 0.4 |
| Total | 100.0 |

EXAMPLE 2

The following example demonstrates that where sodium carbonate is an ingredient in the calcite granules, the order of addition of the granule ingredients to the slurry is critical.

A slurry was prepared according to the following formulation by mixing the ingredients in the order stated.

| Ingredient | Parts by weight |
|---|---|
| Water | 25 |
| Anionic detergent active[7] | 4 |
| Calcite[6] | 20 |
| Sodium carbonate[11] | 10 |
| Sucrose | 4 |

Notes:
[6]As Example 1
[7]Petrelab 550 (ex Petresa) which is approximately sodium alkyl benzene sulphonate in which the alkyl group contains from 10 to 15 carbon atoms.
[11]Measured as anhydrous The slurry at a temperature of 80° C. was pumped via a high pressure pump (at about 40 bar pressure) to an atomising jet. The atomised slurry was dried in a spray drying tower by hot air using conventional procedures and conditions. The air temperature was about 300° C. The physical properties, i.e. bulk density, cohesiveness and strength of the granules were found to be satisfactory in comparison with commercially available products.

The performance of the granules was tested as follows:

The granules were added to 1 liter of 20° FH calcium chloride solution (calcium ion concentration $20\times10^{-4}$ molar) in a Tergotometer (Trade Mark), laboratory scale apparatus at 25° C. and in an amount equivalent to 0.5 g/l calcite together with sufficient sodium carbonate to make a total of 1.5 g/l. The wash liquor was agitated for 15 minutes at 100 rpm. The activity of the granules was determined using as a detergency monitor an artificially soiled test cloth which was present throughout the wash and known to be sensitive to the level of hardness ions in solution. The change in reflectance of the test cloth achieved with the granules was compared with that achieved by a mixture of the same components where the calcite was added as the raw material.

By this method these granules were found to have a performance of 50% that of the calcite raw material. When the experiment was repeated with the exception only that the calcite was added to the slurry after a quarter of the sodium carbonate had been added, the seed activity was found to be about 100% of that of the calcite raw material.

EXAMPLES 3 TO 5

Calcite and anhydrous sodium carbonate were dry mixed and added to a pan granulator. A blend of detergent active material, water and sucrose at 80° C. was sprayed on while the granulator was operated in a conventional manner. The level of water used was the same weight as the detergent active material. The granules which formed were dried in a fluidised bed. The granules had the following final compositions:

| Example No. Ingredient (parts by weight) | 3 | 4 | 5 |
|---|---|---|---|
| Calcite[12] | 20.0 | 20.0 | 20.0 |
| Sodium carbonate | — | 10.0 | 10.0 |
| Anionic detergent active[12] | 4.0 | 4.0 | — |
| Nonionic detergent active[8] | — | — | 3.6 |
| Sucrose | 4.0 | 4.0 | 3.6 |
| Water | 0.5 | 2.0 | 2.0 |

Notes
[12]As Example 2.
[8]Synperonic 7EO.

The physical properties i.e. bulk density, cohesiveness and strength of the granules made according to Examples 3 and 4 were found to be satisfactory in comparison with commercially available products.

The mechanical strengths of the granules were measured using a friability test, in which a sample of the material to be tested is subjected to a spiral air flow. The percentage of fine particles, having a size of less than 150 microns, is measured before and after the test. Any increase in the level of fine particles is an indication of the friability and therefore the mechanical strength of the material. An increase of 10% or less in the level of fine particles is considered to be acceptable.

Results were obtained as follows:

| Example No: | 3 | 4 | 5 |
|---|---|---|---|
| % increase in fine particles | — | 4% | 2% |

The performance of these granules was measured as described in Example 2. The performance of the granules according to Examples 3 and 4 was found to be approximately 100% of the calcite raw material. The performance of the granule according to Example 5 was found to be about 50% of the raw material. This demonstrates a benefit for the use of an anionic detergent active in the granules.

EXAMPLE 6

Calcite granules were prepared in the laboratory by evaporating a hand-stirred dispersion of calcite in an aqueous solution of anionic detergent active and/or sucrose to near dryness on a steam bath, completing the drying in an oven overnight at 80°-100° C., grinding the dried mass with a pestle and mortar, and sieving to obtain 355-1000 microns particles. A Wallace Micro-Indentation Tester was used to provide a quantitative determination of granule strength. Seed crystal activity was determined by adding the granules together with sodium carbonate to water having a hardness of 20° F. containing 10 ppm sodium tripolyphosphate to represent a poison which may in practice be present in a wash liquor. Using a calcium electrode which was insensitive to anionic detergent actives, the level of free calcium ions present after 5 minutes was measured at 20° C. The granules were added at a level of 0.84 g/l and the sodium carbonate at a level of 1.4 g/l. The composition of the granules and the results obtained were as follows.

| Example No: Ingredients (parts by weight) | 6 | 6A | 6B |
|---|---|---|---|
| Calcite[13] | 15.0 | 15.0 | 15.0 |
| Anionic detergent active[13] | 4.0 | 6.0 | — |
| Sucrose | 2.0 | — | 6.0 |
| Granule strength(g) | 100 | 43 | 240 |
| °FH after 5 minutes | 0.06 | 0.1 | 1.6 |

Notes
[13]As in Example 3.

These results demonstrate that while the use of sucrose alone (Example 6B) provides mechanical strength, the performance of the granules is poor. The use of anionic detergent active alone (Example 6A) provides better performance, but mechanical strength is poor. The use of both ingredients (Example 6) gives acceptable mechanical strength and good performance.

EXAMPLE 7

The following granule formulation represents a silicate-free granule which can constitute the whole of a detergent composition for use in conditions where the presence of sodium silicate is not essential:

| Ingredient | % by weight |
|---|---|
| Anionic detergent active | 25 |
| Sodium carbonate | 40 |
| Calcite | 20 |
| Sucrose | 5 |
| Sodium sulphate | 3 |
| Minor ingredients and water | 7 |

EXAMPLE 8

The following formulation represents a silicate containing composition which can be prepared by pan-granulating the calcite granules and adding them to a spray dried base powder together with other ingredients.

| Ingredient | % by weight |
|---|---|
| Calcite granules: | |
| Calcite | 12 |
| Anionic detergent active | 3 |
| Sucrose | 1.5 |
| Spray-dried base: | |
| Anionic detergent active | 5 |
| Nonionic detergent active | 2 |
| Foam control agent | 1.2 |
| Sodium carbonate | 35 |
| Sodium alkaline silicate | 8 |
| Sodium sulphate | 6 |
| Other ingredients | |
| Sodium perborate tetrahydrate | 18 |
| Minor ingredients | 1.2 |
| Total water | balance |

EXAMPLES 9 TO 20

The following granules were prepared by spray drying (parts by weight):

| Example No: | 9 | 10 | 11 | 12 | 13 | 14 | 15 | 16 | 17 | 18 | 19 | 20 |
|---|---|---|---|---|---|---|---|---|---|---|---|---|
| Ingredients | | | | | | | | | | | | |
| Calcite[14] | 20 | 20 | 20 | 20 | 20 | 20 | 20 | 20 | 20 | 20 | 20 | 20 |
| Sodium carbonate[15] | 10 | 10 | 10 | 10 | 10 | 10 | 10 | 10 | 10 | 10 | — | 10 |

-continued

| Example No: | 9 | 10 | 11 | 12 | 13 | 14 | 15 | 16 | 17 | 18 | 19 | 20 |
|---|---|---|---|---|---|---|---|---|---|---|---|---|
| Anionic active[14] | 4 | 4 | 4 | 4 | — | — | 4 | 4 | 4 | 4 | 4 | 4 |
| Soap | — | — | — | — | 4[16] | 4[17] | — | — | — | — | — | — |
| Sucrose | 4 | — | — | — | 4 | 4 | 1 | 3 | 5 | 7 | 4 | — |
| Sorbitol | — | 4 | — | — | — | — | — | — | — | — | — | — |
| Maize starch | — | — | 4 | — | — | — | — | — | — | — | — | — |
| Lactose | — | — | — | — | — | — | — | — | — | — | — | 4 |
| Neutral silicate | — | — | — | 4 | — | — | — | — | — | — | — | — |
| Silica | — | — | — | — | — | — | — | — | — | — | 5 | — |
| Moisture | | | | | | 1.2 | | | | | | |

Notes:
[14]As Example 1.
[15]Measured as anhydrous.
[16]Coconut soap (sodium)
[17]Hardened tallow soap (sodium)

A slurry was prepared having a nominal water content of 40% as follows. To 18.8 parts water was added 5 parts of sodium carbonate. 8.5 parts of anionic active in paste form was then added (being equivalent to 4 parts of the active material calculated on an anhydrous basis). 4 parts of the binding agent were added followed by 20 parts of calcite powder. Finally a further 5 parts of sodium carbonate were added. The slurry was then spray dried to a moisture content of 1.2 parts.

This process was modified as necessary to provide the different formulations given above.

When lactose in the form of dried whey powder was used as the binder it was necessary to add further water to the slurry to make it pumpable.

The maize starch used as a binder was not dispersible in the slurry and produced an off-colour product.

Example 9 is similar in formulation to Example 1. Examples 10, 11 and 20 utilize different sugar materials in place of the sucrose. In Example 12 (comparative) the granules contain silicate as a binder in place of the sucrose. In Examples 13 and 14 (comparative) the granules contain soap in place of the synthetic anionic detergent active. In Examples 15 to 18, the level of sucrose in the granules is progressively increased. In Example 19, the granules further contain silica, but no sodium carbonate.

These granules were tested in a number of different ways as explained in more detail below.

In a seed activity test the granules were added to 1 liter of water at 25° C. having a hardness of 20° FH ($20\times10^{-4}$ molar free calcium ions) containing 10 ppm sodium tripolyphosphate at a dosage corresponding to 1 g/l calcite. The free calcium ion concentration was measured after 15 minutes. Results included the following:

| Example No | Granule Type | Free Calcium (g ion/liter $\times 10^{-4}$) |
|---|---|---|
| 9 | Calcite/carbonate/sucrose/anionic | 0.044 |
| 12 | Calcite/carbonate/silicate/anionic | 0.210 |
| 13 | Calcite/carbonate/sucrose/soap | 1.100 |
| 14 | Calcite/carbonate/sucrose/soap | 0.560 |
| 19 | Calcite/silica/sucrose/anionic | 0.080 |

These results illustrate that the granules of comparative examples 12, 13 and 14 all showed poor seed activity. All other granules tested showed a seed activity at least as good as Example 19.

In a machine dispensibility test, 150 g of the granules were placed in the dispenser of a HOOVER (Trade Mark) automatic washing machine. Cold water was allowed to enter the dispenser at a rate of 2 liters per minute for 2 minutes. The water had a hardness of 24° FH. The water pressure was 5 psi. After allowing the water to drain naturally out of the dispenser, the weight of the powder residue therein was measured. Results included the following:

| Example No | Granule Type | Wet Residue (g) |
|---|---|---|
| 9 | Calcite/carbonate/sucrose/anionic | 177 |
| 10 | Calcite/carbonate/sorbitol/anionic | 4 |
| 19 | Calcite/silica/sucrose/anionic | 12 |

These results demonstrate that sucrose can be replaced by sorbitol to provide a significant improvement in dispensibility, and the carbonate can be replaced by silica to achieve a similar effect.

A dispersibility test was also carried out as follows. 150 cc of water is placed in a beaker and stirred at such a rate as to generate a vortex of between 5 and 10 cm. 10 g of the material to be tested is added and the degree of dispersibility is determined by visual estimation. Each granule was allotted a dispersibility grade on the basis of this test as follows:

1=Granules are completely dispersible.
2=>75% of granules are dispersible.
3=>50% of granules are dispersible.
4=>25% of granules are dispersible.
5=All powders clotted.

The results were as follows:

| Example No | Granule Type | Dispersibility Grade |
|---|---|---|
| 15 | 1 part sucrose | 2 |
| 16 | 3 parts sucrose | 3 |
| 9 | 4 parts sucrose | 3 |
| 17 | 5 parts sucrose | 3 |
| 18 | 7 parts sucrose | 3–4 |

A friability test was also carried out, as described in Examples 3–5 above and the results were as follows:

| Example No | Granule Type | Δ% Fines |
|---|---|---|
| 13 | Calcite/carbonate/sucrose/soap | 12.3 |
| 17 | 5 parts sucrose | 9.3 |

All other granules tested from Examples 9–20 had an increase in the percentage of fines of 8.9% or less. These results demonstrate that the use of soap in place of a non-soap anionic active material produces a granule with unacceptable mechanical strength.

EXAMPLES 21 AND 22

Two powders having the following nominal formulation were prepared by pan granulation using an Eirich (Trade Mark) pan.

| Example No: | 21 | 22 |
|---|---|---|
| Ingredients | | |
| Calcite[18] | 20 | 20 |
| Sodium carbonate[19] | 10 | 10 |
| Anionic active[18] | 4 | 4 |
| Sucrose | 4 | 4 |

-continued

| Example No: | 21 | 22 |
|---|---|---|
| Moisture | 1.2 | 1.2 |

Notes:
[18]As Example 1.
[19]Measured as anhydrous.

The granules of Example 21 were prepared by spraying a mixture of the anionic active paste, sucrose and water onto a mixture of calcite and sodium carbonate solids. The granules of Example 22 were prepared by a two-stage spray-on technique. Firstly an anionic active paste/water mixture is sprayed on to a mixture of calcite and sodium carbonate solids, and thereafter a sucrose solution in water is sprayed on. In both cases excess water in the granules is removed by tray drying in an oven at 70° C.

These granules were tested in the same way as those in Examples 9 to 20 and results were as follows:

| Example No: | 9 | 21 | 22 |
|---|---|---|---|
| Seed activity (free $Ca^{++}$ g ion/1 $\times 10^{-4}$) | 0.044 | 0.036 | 0.046 |
| Machine dispensibility (g wet residue) | 177 | 95 | 88 |
| Mechanical strength (Δ% fines) | 3.1 | 12.8 | 3.7 |

These results demonstrate that granules with greater mechanical strength are obtainable when the sucrose is sprayed on separately from and subsequent to spraying on the anionic active.

We claim:

1. A detergent composition comprising:

(a) at least 5% by weight of the composition of silicate free detergent granules having an average size between 150 and 1800 microns and comprising:

(i) at least 15% by weight of a water-insoluble particulate carbonate material which is a seed crystal for calcium carbonate and which is selected from calcite, vaterite, aragonite and mixtures thereof;

(ii) at least 5% by weight of a non-soap detergent active material which is a dispersant for the water-insoluble particulate carbonate material and which is selected from non-soap anionic detergent active material, nonionic detergent active materials and mixtures thereof;

(iii) at least 5% by weight of a sugar selected from sucrose, glucose, fructose, maltose, cellobiose, lactose and sorbitol, said percentages being based on the total weight of ingredients (i), (ii) and (iii), (b) from 5% to 75% by weight of the composition of an alkali metal carbonate; and (c) from 5% to 30% by weight of the composition of an alkali metal silicate.

2. Composition of claim 1, wherein said non-soap detergent active material comprises 5 to 40% by weight of the composition.

* * * * *